US006827694B2

(12) United States Patent
Gladoun

(10) Patent No.: US 6,827,694 B2
(45) Date of Patent: Dec. 7, 2004

(54) POSTURE TRAINING DEVICE

(76) Inventor: Vladimir Gladoun, 1746 E. 13th St. Apt. 5A, Brooklyn, NY (US) 11229

( * ) Notice: Subject to any disclaimer, the term of this patent is extended or adjusted under 35 U.S.C. 154(b) by 224 days.

(21) Appl. No.: 10/151,888

(22) Filed: May 22, 2002

(65) Prior Publication Data

US 2003/0220591 A1 Nov. 27, 2003

(51) Int. Cl.[7] ..... A66B 5/103; A61B 5/117
(52) U.S. Cl. ..... 600/594
(58) Field of Search ..... 600/594; 607/43, 607/115; 602/19, 13, 17; 128/845, 870; 2/44

(56) References Cited

U.S. PATENT DOCUMENTS

| | | | | | |
|---|---|---|---|---|---|
| 5,199,940 | A | * | 4/1993 | Morris et al. | 602/19 |
| 5,643,329 | A | * | 7/1997 | Solomonow et al. | 607/43 |
| 5,868,691 | A | * | 2/1999 | Vishnevsky | 602/19 |
| 6,540,707 | B1 | * | 4/2003 | Stark et al. | 602/13 |
| 6,554,781 | B1 | * | 4/2003 | Carter et al. | 600/594 |

* cited by examiner

*Primary Examiner*—Max F. Hindenburg
*Assistant Examiner*—Brian Szmal

(57) ABSTRACT

A posture training device for back muscles direct training to maintain good posture. Rigid spinal curvature model with sensors and single attachment point method provide preferable shoulder based and alternative belt based embodiments.

6 Claims, 3 Drawing Sheets

POSTURE TRAINING DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

The present invention pertains to posture improving devices. The device works by training user's back muscles directly. It is considered important to train user's back muscles to maintain good spinal curvature for two reasons. The first reason is that the correct spinal curvature is the most important part of good posture, which is in turn a part of good personal appearance. The second reason is that strong, trained back muscles are able to prevent and help to cure a range of back pain problems naturally. For instance, strong back muscles maintain spine bones and disks in their locations and prevent them from loosing. Apparently weak back muscles are unable to do it properly. In this case a herniated disk can push on nerve root and cause back pain problems. These problems described in great detail in a book titled "Gait, Posture and Health" by V. Gladoun, et al. Minsk, Belarus, 1992.

A number of patents on the subject were registered in USPTO. They can be grouped as followed:

1. Rigid posture training devices with two or more attachment points. Such devices disclosed in several patents beginning with as early instances as U.S. Pat. No. 0,443,764 and up to later ones as U.S. Pat. No. 5,868,691 and U.S. Pat. No. 5,199,940. Some of them like U.S. Pat. No. 0,443,764 use a spinal curvature model with two or three attachment points to a user's torso, others as U.S. Pat. No. 5,868,691 and U.S. Pat. No. 5,199,940 implement a rigid structure with the same functionality as spinal curvature model and two or more attachment points method. This approach allows secure attach a user's back to a device, hold his/her spine in a predetermined good curvature position and restrict any spine flexibility in order to accustom the user to good posture. This approach has a drawback. These devices are unable to train user's back muscles to maintain good posture. Wearer's back muscles do not have to support the correct spinal curvature, because the rigid device strength does it anyway. For instance, the wearer can have his/her back muscles totally relaxed, but the spinal curvature will be still good due to the device support.

2. Flexible posture training devices with two or more attachment points. Such device disclosed in U.S. Pat. No. 3,608,541. The device and a user's spine change their curvatures simultaneously. The device measures its own curvature changes and provides the user with feedback signals when the device curvature is changed to a greater than predetermined extend. This approach has some drawbacks. A good human spine has inward and outward curves and because of that it should be normally curved, no more and no less. Mentioned device shape is much simpler and does not fit the wearer's spinal curvature precisely. It causes the problem that the device is unable to provide precise measurements and therefore good feedback means with taking all major spine curves into consideration.

One more example of posture training flexible devices is a T-shaped device disclosed in U.S. Pat. No. 4,730,625. The device is permanently attached to a T-shirt. That is an obvious limitation. Also it is unable to provide precise measurements for the same reason that was described above. For instance, palm wide holes are allowed.

3. Shoulder strap posture training devices. Such devices disclosed in U.S. Pat. No. 4,007,733 and U.S. Pat. No. 4,055,168, each of which provides an indication of the distance between the ends of the wearer's spinal column by registering changes in the strap tension. This approach has the same drawback as posture training flexible devices. Their simple shapes are unable to provide precise measurements and therefore feedback signals for all major spine curves.

4. Belt shaped posture training devices with feedback means. Such devices disclosed in U.S. Pat. No. 5,304,984, U.S. Pat. No. 4,914,423, U.S. Pat. No. 4,871,998, U.S. Pat. No. U.S. Pat. No. 4,846,157. Each of these devices is able to train wearer's abdominal muscles directly in order to improve his/her posture. For that purpose the wearer receives a feedback signals when the device belt tension exceeds a predetermined amount. At that point the wearer should tight his/her abdominal muscles in the effort to stop the feedback signals. In this case spinal curvature adjustment is rather an additional mental effort than an effort caused directly by the device work. For instance, the device will not provide a feedback signals when wearer's belly muscles are tightened but the spinal curvature is not really good. Therefore this type of devices uses the opposite approach, which is direct abdominal muscles training and indirect back muscles training.

5. Posture-Monitoring Headband Device disclosed in U.S. Pat. No. 5,158,089 and Hat Attached Posture Indicator disclosed in U.S. Pat. No. 2,494,278 designed to provide audible feedback of sensed forward or backward deviation from ideal head inclination. This type of posture training devices can work as a reminder only for users who know how to assume good posture without any device help. Otherwise user's head position feedback signals can be misleading.

BRIEF SUMMARY OF THE INVENTION

The present device advantage is that it provides direct back muscles training and feedback signals with taking all major spinal curves into measurements versus all other approaches described in the Background Of The Invention. For that purpose personally adjustable rigid spinal curvature model with touch detecting sensors is implemented in the device. Furthermore, the spinal curvature model is connected to a housing by single attachment point method. This approach provides new to the field and completely different functionality that allows direct back muscles training. In addition it allows manufacturing comparatively simple devices. Shoulder based and alternative belt based embodiments provide wearers with a choice for easy and convenient ways to use the device in accordance with personal activities and preferences.

DETAILED DESCRIPTION OF THE INVENTION

Figure 1:
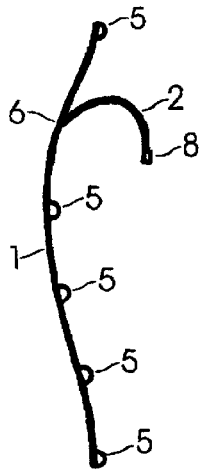
FIG. 1 is a side view of a preferred posture training device shoulder based embodiment.
Figure 2:
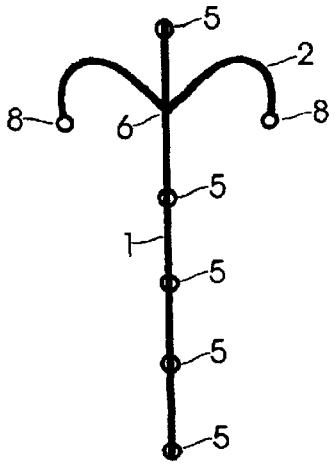
FIG. 2 is a plain view of the preferred posture training device shoulder-based embodiment shown in FIG. 1.

Referring to FIGS. 1 and 2 the present invention device preferred embodiment consists of a spinal curvature model 1, a shoulder based housing 2 and feedback means (described below).

Figure 3:
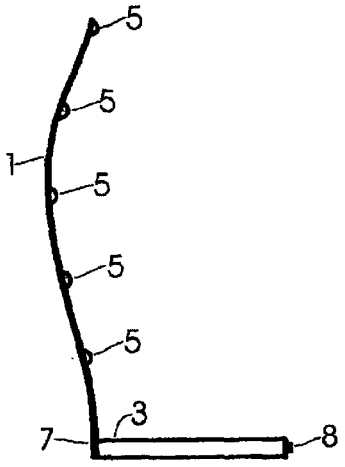
FIG. 3 is a side view of an alternative posture training device belt based embodiment.
Figure 4:
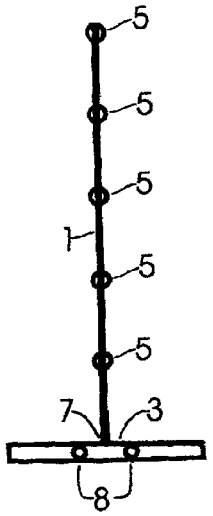
FIG. 4 is a plain view of the alternative posture training device belt based embodiment shown in FIG. 3.

Referring now to FIGS. 3 and 4 the present invention device alternative embodiment also consists of the same parts, but the housing 3 is belt based.

The spinal curvature model 1 further referring to FIGS. 5, 6, 7 and 8 should be curved exactly as wearer's spinal curvature when he or she assumes good posture with all correct inward and outward curves. It allows installing touch-detecting sensors 5 in parallel to and in touch with wearer's vertebrae as demonstrated in FIG. 9 and FIG. 11. The spinal curvature model 1 should be rigid enough to keep the shape during extended daily use, but on the other hand it should be flexible enough to be able to attain user's spine shape.

Good posture is defined as neutral in medicine in terms of that person's back muscles do not have unnecessary strength to maintain it because his/her spine is in a balance.

Figure 15:
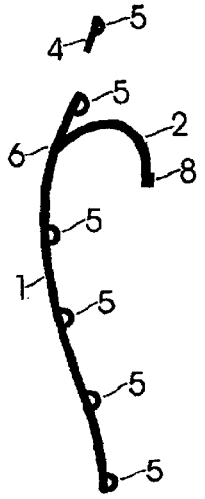
FIG. 15 is a side view of the preferred posture training device shoulder based embodiment shown in FIG. 1 with detached cervical part.
Figure 16:
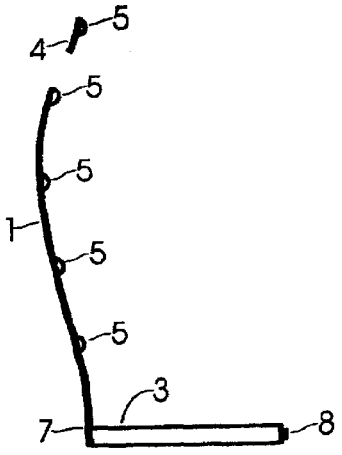
FIG. 16 is a side view of the alternative posture training device shoulder-based embodiment shown in FIG. 3 with detached cervical part.
Figure 5:
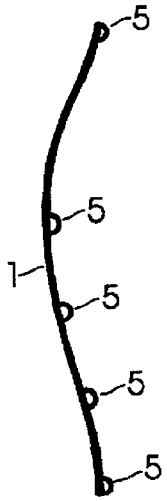
FIG. 5 is a side view of a spine curvature model with sensors, which is implemented in the preferred posture training device shoulder based embodiment shown in FIG. 1.
Figure 6:
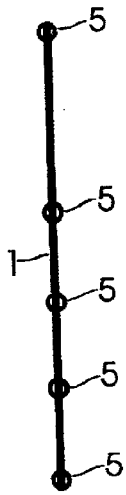
FIG. 6 is a plain view of the spine curvature model with sensors shown in FIG. 5.
Figure 17:
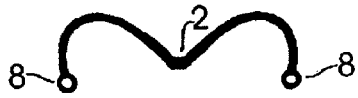
FIG. 17 is a plain view of the shoulder base, which is implemented in the preferred posture training device shoulder based embodiment shown in FIG. 1.
Figure 7:
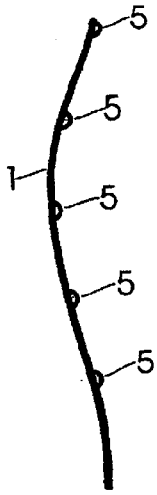
FIG. 7 is a side view of a spine curvature model with sensors, which is implemented in the alternative posture training device belt based embodiment shown in FIG. 3.
Figure 8:
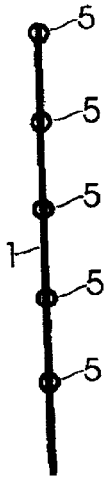
FIG. 8 is a plain view of the spine curvature model with sensors shown in FIG. 7.
Figure 18:
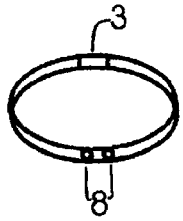
FIG. 18 is an isometric view of the belt base, which is implemented in the alternative posture training device belt based embodiment shown in FIG. 3.

The spinal curvature model length can be as long as the user's spine or shorter. For instance, cervical and sacrum parts can be excluded from training partially or completely. Sacrum muscles will not be trained anyway, because we do not have this physical ability. Cervical part could be excluded completely or partially in some cases if it interferes with user's routine activity. Preferably a user should be able to exclude this part temporary or permanently. For that purpose a spinal curvature model cervical extension 4 could be implemented as depicted on FIGS. 15 and 16 with sensors 5, which can be dismounted and mounted back to spinal curvature model. Also spinal curvature model lumbar part could be shorter in some cases than wearer's spine corresponding part for convenient use reason. It also can be adjusted with a spinal curvature model extension.

The spinal curvature model width is not restricted and preferably should be manufactured as thin as possible to seat better on user's back against his/her spine.

Due to use the single attachment point method the housing and therefore the device has two preferred embodiments. First one is the shoulder based preferred housing 2 as shown in FIGS. 17, 1, 2, 9, 10, 13, 15 and the other one, which is the belt based alternative housing 3 as depicted on FIGS. 18, 3, 4, 11, 12, 14, 16. In the preferred shoulder based embodiment the spinal curvature model is attached by it's upper part 6 to the housing as demonstrated in FIGS. 1, 2, 9, 10, 13 and 15. Apparently in the belt based alternative solution the spinal curvature model is attached by it's lower part 7 to the housing as shown in FIGS. 3, 4, 11, 12, 14, 16. Housing 2 and 3 are connected to the spinal curvature model by single attachment point method. In other words the housing has only one connection point to the spinal curvature model. In this case the device physical rigid strength does not hold user's spine in good spinal curvature shape and does not limit the user's spine flexibility. It only holds the spinal curvature model with sensors against the user's spine as demonstrated in FIGS. 9 and 11.

Figure 9:
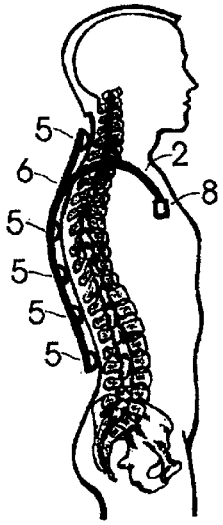
FIG. 9 is a side view of a person wearing the preferred posture training device shoulder based embodiment shown in FIG. 1 when the person is experiencing good posture.
Figure 10:
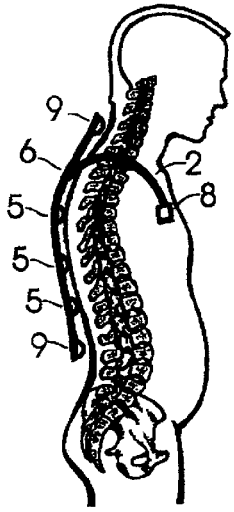
FIG. 10 is a side view of the person shown in FIG. 9 when the person is experiencing poor posture.
Figure 13:
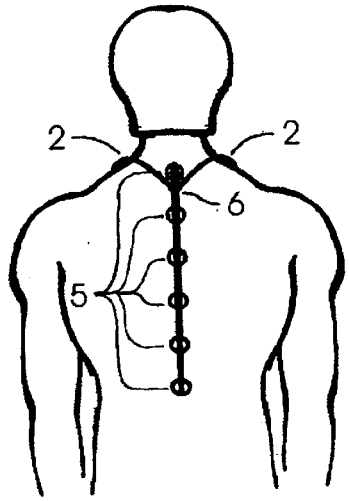
FIG. 13 is a back view of the person wearing preferred posture training device shoulder based embodiment shown in FIG. 9.
Figure 11:
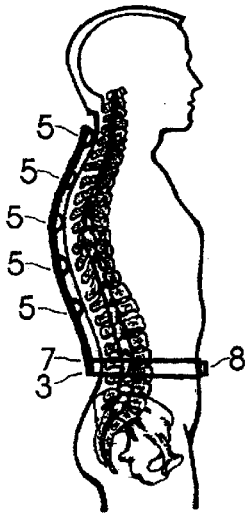
FIG. 11 is a side view of a person wearing the alternative posture training device belt based embodiment shown in FIG. 3 when the person is experiencing good posture.
Figure 12:
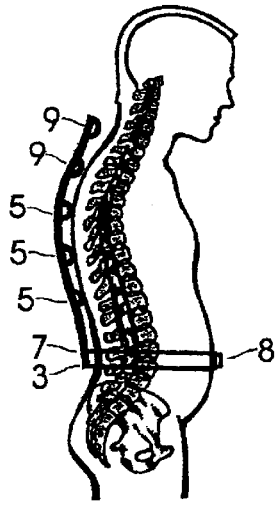
FIG. 12 is a side view of the person shown in FIG. 11 when the person is experiencing poor posture.
Figure 14:
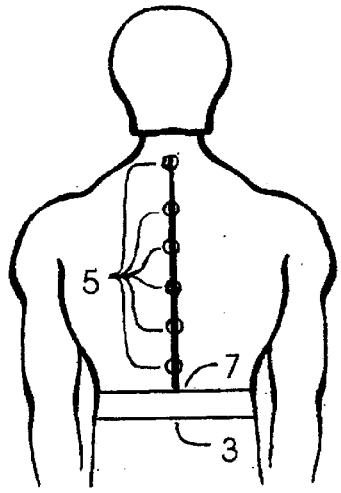
FIG. 14 is a back view of the person wearing alternative posture training device shoulder based embodiment shown in FIG. 11.

The device feedback means consist of touch detecting sensors 5 as depicted on FIGS. 1–16 and signaling means. Feedback means provide feedback signals to a user when his/her predetermined good spinal curvature is changed to unacceptable level. Sensors are located on a spinal curvature model against user's spine. They detect the vertebrae bone touches. When the user experiences good posture, spinal curvature has all correct inward and outward curves, all sensors 5 have touch as shown in FIGS. 9 and 11 and no signals send to signaling means. When the user experiences poor posture, spinal curvature does not have all correct inward and outward curves, one or more sensors 9 loose the touch as demonstrated in FIGS. 10, 12 and feedback signals send to signaling means.

Signaling means can provide audio signals to a user. Audio signals could be almost any sound from just a buzz to some music or recorded voice like"Please adjust your posture". Audio signal controls 8 as depicted on FIGS. 1–4, 9–12, 15–18 with adjustable feedback signal delay feature can be incorporated in the device for convenient use in routine daily activities. For instance, a user can deliberately change his/her spinal curvature for a short time in order to do some his/her routine activities and then assume good posture again. In this case there is no need for the device feedback signals.

Although the good spinal curvature is one and is considered the most important part of good posture the other parts, which are abdominal and chest muscles are also important. They also could be trained, but indirectly. When a user adjusts his/her spinal curvature to assume good posture it helps to adjust the chest and abdominal muscles as well because that changes are related in human body.

In present invention a combination of two; a rigid spinal curvature model equipped with touch detecting sensors and single attachment point method provides new to the field distinguished approach in user training to maintain good posture. Lets compare this approach with others known to the field:

1. The present invention device does not lock user's spine to restrict its flexibility as rigid posture training devices, which implement a combination of a rigid spinal curvature model or a rigid structure with the same functionality and two or more attachment point method. In the present device the spinal curvature model has new functionality. It is not a restricting tool anymore, but it is a touch detecting sensor holder. It allows to monitor how a user back muscles maintain good posture in order to train them. Also single attachment point method does not restrict wearer's spine flexibility that allows doing most of routine daily activities.
2. Now compared with shoulder strap posture training devices or flexible posture training devices with two or more attachment points the present device provides more precise measurements and therefore better feedback means with taking all major inward and outward spine curves into consideration.
3. The present device provides direct training for user's back muscles and indirect training for user's abdominal muscles versus belt shaped posture training devices approach, which is user's abdominal muscles direct training and indirect training for his/her back muscles.
4. Further compared with Posture-Monitoring Headband Devices, the present device assures that a user assumes and maintains good posture.

The present invention is not limited to the specific embodiments described and illustrated above. Instead, the invention is construed according to the claims specified below.

What is claimed is:

1. A posture training device comprising:

a rigid spinal curvature model;

a spinal curvature model housing; and feedback means, wherein said rigid spinal curvature model comprises a plurality of touch detecting sensors.

2. The posture training device of claim 1, wherein housing is adapted to be placed over the shoulder of a user.

3. The posture training device of claim 1, wherein said housing comprises a belt.

4. The posture training device of claim 1, wherein said spinal curvature model and said housing is attached at a single attachment point.

5. The posture training device of claim 4, wherein said housing is adapted to be placed over the shoulders of a user.

6. The posture training device of claim 4, wherein said housing comprises a belt.

* * * * *